US005278575A

United States Patent [19]

Thomas

[11] Patent Number: 5,278,575

[45] Date of Patent: Jan. 11, 1994

[54] BROADBAND MICROSTRIP TO SLOTLINE TRANSITION

[75] Inventor: Mike D. Thomas, Thousand Oaks, Calif.

[73] Assignee: Hughes Aircraft Company, Los Angeles, Calif.

[21] Appl. No.: 765,858

[22] Filed: Sep. 26, 1991

[51] Int. Cl.[5] ..... H01Q 9/28

[52] U.S. Cl. ..... 343/795; 333/26; 333/238; 343/700 MS

[58] Field of Search ..... 333/26, 33, 238; 343/767, 795

[56] References Cited

U.S. PATENT DOCUMENTS

| | | | |
|---|---|---|---|
| 3,678,047 | 10/1973 | Campbell et al. | 333/238 X |
| 3,769,617 | 10/1973 | West | 333/238 |
| 4,500,887 | 2/1985 | Nester | 343/795 X |
| 4,739,519 | 4/1988 | Findley | 333/26 X |

*Primary Examiner*—Paul Gensler
*Attorney, Agent, or Firm*—L. A. Alkov; W. K. Denson-Low

[57] ABSTRACT

A broadband transition between microstrip transmission line and slotline transmission line. The geometry of integrating the two transmission lines results in a broadband microstrip shunt circuit across the slotline, and a broadband slotline open circuit in the direction opposite of propagation on the slotline. This produces direct coupling between the two transmission lines. The transition does not require any intermediate transmission line types between the microstrip and slotline, and no frequency dependent tuning stubs are used to produce the shunt circuits and open circuits required for coupling. The result is a broadband transition which can be fabricated using standard etching techniques and requiring no plated through holes.

2 Claims, 3 Drawing Sheets

BROADBAND MICROSTRIP TO SLOTLINE TRANSITION

BACKGROUND OF THE INVENTION

The present invention relates to improvements in the transitioning between microstrip and slotline microwave transmission lines.

Flared slot radiators are becoming increasingly popular in active radar arrays because of their broadband characteristics and suitability to active array architectures. Presently, a new frequency dependent microstrip to slotline transition must be designed for each application.

Conventional transitions between microstrip and slotline transmission lines have utilized either an intermediate transmission line type, such as parallel strip, or frequency dependent tuning stubs. These conventional transitions therefore require more area on the circuit board, and also are limited in frequency bandwidth.

It is therefore an object of the invention to provide a broadband transition between microstrip and slotline transmission lines.

SUMMARY OF THE INVENTION

The invention is a transition between two types of transmission lines, microstrip lines and slotlines. What is new about this particular transition is the geometry employed in integrating the two transmission line types at the transition. The geometry used results in a broadband microstrip short circuit across the slotline and a broadband slotline open circuit in the direction opposite of propagation on the slotline. These two characteristics are required for direct coupling from the microstrip to the slotline. There are no intermediate transmission line types between the microstrip and the slotline, and no frequency dependent tuning stubs are used to produce the short circuits and open circuits required for coupling. The result is a broadband transition which can be fabricated using standard etching techniques and requiring no plated through holes.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

A microstrip to slotline transition in accordance with the invention is formed by integrating a microstrip transmission line with a double sided slotline, as shown in FIGS. 1–4. As is well known, a microstrip transmission line is a two wire transmission line formed by a conducting strip located over a conducting groundplane. The characteristic impedance of the microstrip line is determined by the width of the conducting strip, its height above the groundplane, and the dielectric constant of the material between the two. A double-sided slotline is a slot transmission line formed by the co-linear adjacent edges of two conducting groundplanes which are located on opposite sides of a dielectric slab. The characteristic impedance of the double-sided slotline is determined by the amount of overlap of the two edges of the groundplanes which form the slotline, the thickness of the dielectric slab between them, and the dielectric constant of the slab material.

Figure 1:
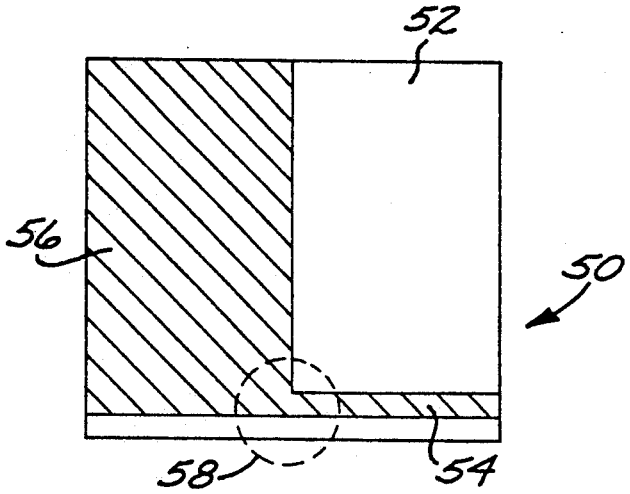
FIG. 1 is a top view of a microstrip to slotline transition in accordance with the invention.

FIG. 1 is a top view of the transition 50, and shows the conductive regions as cross-hatched areas on the top surface of the dielectric substrate 52; the conductive regions define various elements of the transmission lines. The conductive layer on the top surface defines a microstrip transition line 54, one of the slotline groundplanes 56, and a transition region 58. The microstrip transition line 54 joins the groundplane 56 at the transition 58.

Figure 2:
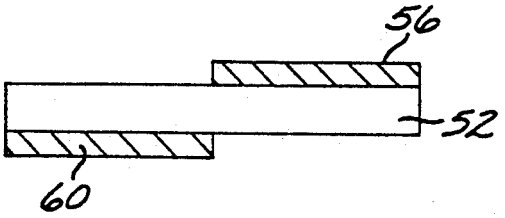
FIG. 2 is an output end view of the transition of FIG. 1.

FIG. 2 is an output end view of the transition 50 of FIG. 1 showing the slotline groundplanes 56 and 60 for a double-sided slotline.

Figure 3:
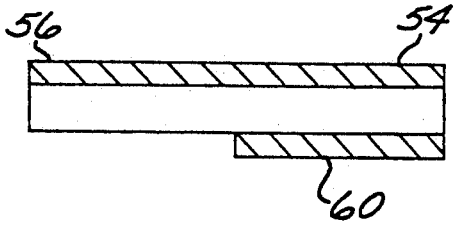
FIG. 3 is an input end view of the transition of FIG. 1.

FIG. 3 is a transition end view showing the microstrip conductor strip 54, slotline groundplane 56 and slotline groundplane 60.

Figure 4:
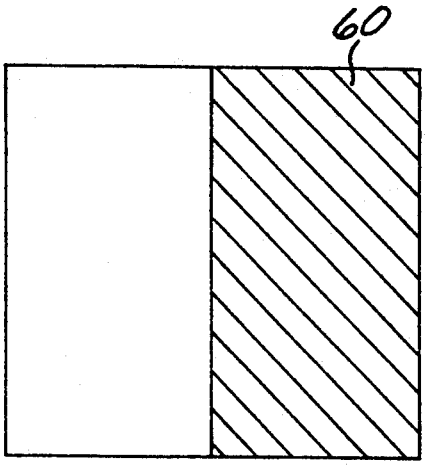
FIG. 4 is a bottom view of the transition of FIG. 1.

FIG. 4 is a bottom view showing again the microstrip and slotline groundplane 60.

The microstrip transmission line and the double-sided slotline are respectively fabricated so that each transmission line has the same nominal characteristic impedance.

As illustrated in FIGS. 1–4, one of the groundplanes (groundplane 60) which comprises the double sided slotline is also utilized as the groundplane for the microstrip line. This produces a broadband microstrip shunt connection across the slotline at their point of intersection at area 58. The microstrip shunt connection is located at the edges of the groundplanes 56 and 60, which also creates a broadband slotline open circuit at one end of the slotline. The groundplane edges, which run along the input end shown in FIG. 3, are an abrupt, very high impedance termination at the end of the slotline transmission line and which is formed along the line between groundplanes 56 and 60. The common location of the microstrip shunt across the slotline and the slotline open circuit causes strong coupling from the microstrip to the slotline. The shunt connection of the microstrip across the end of the slotline causes the microstrip termination impedance to be the parallel combination of the slotline characteristic impedance and the high impedance at that end of the slotline. If the slotline characteristic impedance is the same as that of the microstrip line, the transition is well matched and has a low VSWR. The signal propagates down the slotline toward the output end because the high impedance reflects signals toward the output end in phase with the signal which is already propagating there. Similarly, signals incident on the transition from the slotline will be strongly coupled into the microstrip.

Figure 5:
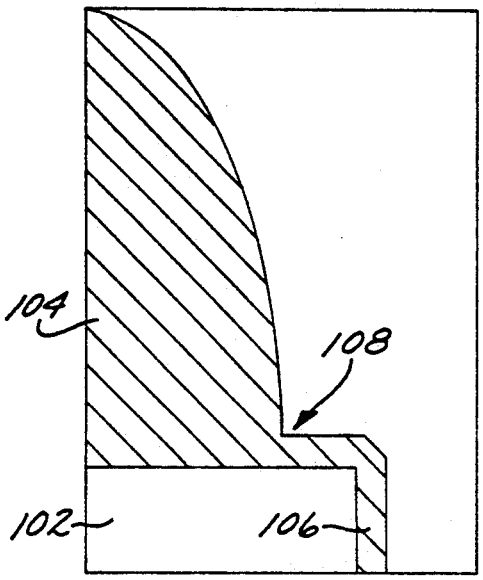
FIG. 5 is a top view of a doublesided printed flared slot radiator embodying the invention.
Figure 6:
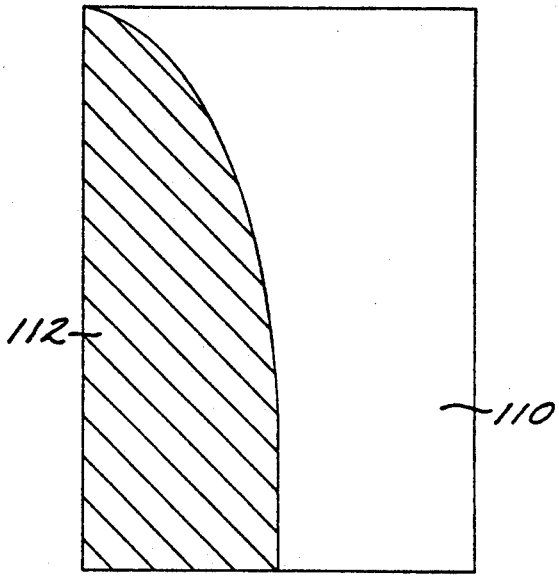
FIG. 6 is a bottom view of the flared slot radiator of FIG. 5.
Figure 7:
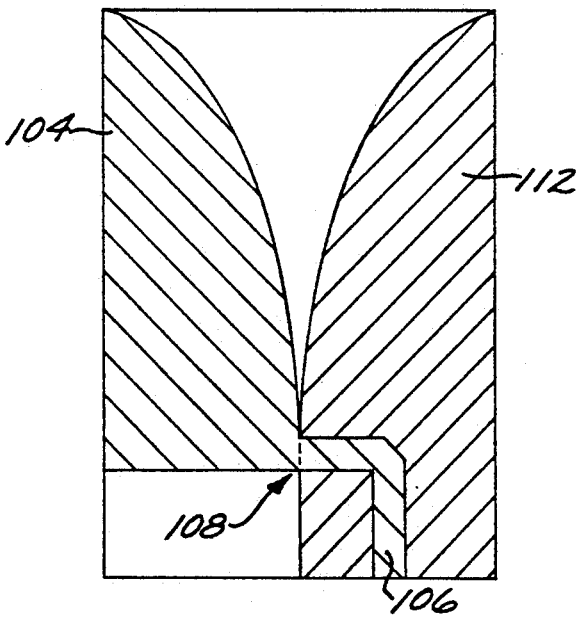
FIG. 7 is an overlay view showing the radiator elements formed on the top and bottom side of the transition of FIG. 5.

FIGS. 5–7 illustrate a doublesided printed flared slot radiator employing a broadband feed circuit in accordance with the present invention. The radiator comprises a planar dielectric substrate having upper and lower surfaces 102 and 110. The upper surface 102 has conductive regions formed thereon by conventional photolithographic techniques which define a first flared radiator element 104 and a microstrip transmission line conductor 106. The radiator element 104 and conductor 106 meet directly at transition region 108.

FIG. 6 shows a bottom view of the flared notch radiator, with the lower surface 110 of the substrate patterned to define lower flared radiator element 112.

FIG. 7 is a transparent top view of the flared notch radiator to show the overlapping of the microstrip conductor line 106 with the lower conductive radiator element 112. Thus, the conductive region defining the element 112 serves as the groundplane for the microstrip transmission line. This produces a broadband microstrip shunt across the slotline at the point of intersection at region 108. The microstrip shunt is located at the edges of the groundplanes which also creates a broadband open circuit at one end of the slotline. The common location of the microstrip shunt across the slotline and the slotline open circuit causes strong coupling from the microstrip to the slotline, thereby launching energy from the microstrip into the slotline and into free space. Similarly, energy incident on the transition from the slotline will be strongly coupled into the microstrip.

Figure 8:
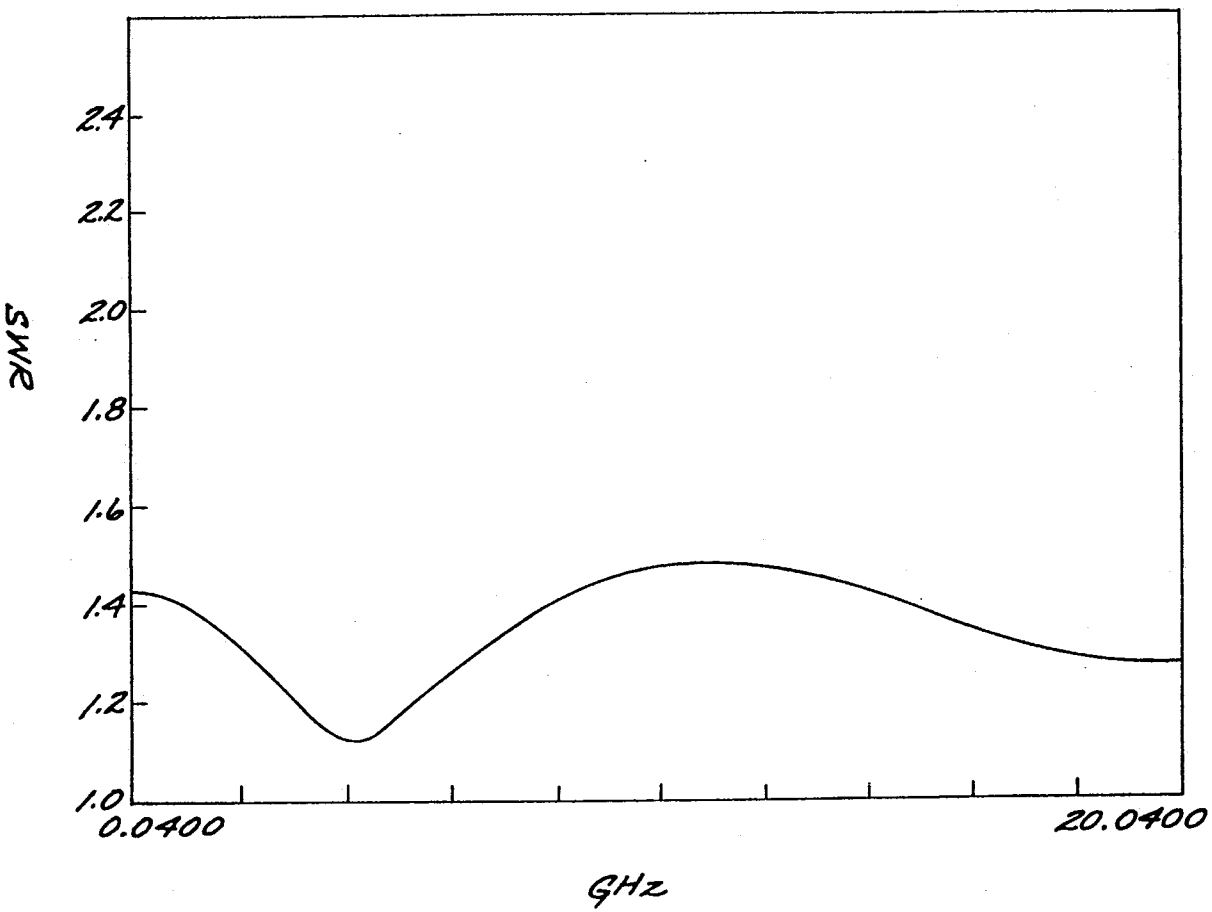
FIG. 8 is a graph illustrating the measured VSWR of an exemplary transition embodying the invention as a function of frequency.

Performance has been verified by measurement (see FIG. 8). In this example, the measured VSWR is less than 1.5:1 across the frequency band from 40 MHz to 20 GHz.

The transition of the present invention exhibits an excellent impedance match over an extremely broad frequency bandwidth. Moreover, the transition is very compact and is relatively easy to fabricate.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A double-sided flared slot radiator having a microstrip feed circuit, comprising:

a dielectric substrate having first and second opposed surfaces;

a first flared radiator region defined on said first surface by a first conductive region on said first surface;

a second flared radiator region defined on said second surface by a second conductive region on said second surface;

said first and second flared radiator regions defining a radiator notch at an area of overlap of said radiator regions;

a microstrip transmission line comprising a conductor line defined on said first dielectric surface by a transmission line conductive region, and a groundplane defined by said second flared radiator region, said transmission line transitioning directly into said first flared region adjacent said notch;

wherein said first and second radiator regions define a double sided slotline transmission line in the vicinity of said notch;

said slotline transmission line having a longitudinal axis along said dielectric substrate and said conductor line being transverse to said longitudinal axis in the vicinity of said notch; and wherein a broadband microstrip shunt circuit occurs across said slotline transmission line and a broadband slotline open circuit occurs at one end of said slotline transmission line, thereby resulting in strong coupling between said microstrip and said slotline such that wave propagation and corresponding energy down the slotline is in one direction toward output end and energy incident on the transition from the slotline is in strong coupling into the microstrip transmission line, so that energy is launched from the microstrip into the slotline and into free space.

2. The radiator of claim 1 wherein said microstrip transmission line is characterized by a microstrip characteristic impedance, and said slotline transmission line is characterized by a slotline characteristic impedance which nominally equals said microstrip characteristic impedance.

* * * * *